US010711619B2

(12) United States Patent
Marsh et al.

(10) Patent No.: US 10,711,619 B2
(45) Date of Patent: Jul. 14, 2020

(54) TURBINE AIRFOIL WITH TURBULATING FEATURE ON A COLD WALL

(71) Applicant: Siemens Aktiengesellschaft, München (DE)

(72) Inventors: Jan H. Marsh, Orlando, FL (US); Paul A. Sanders, Charlotte, NC (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 87 days.

(21) Appl. No.: 16/088,622

(22) PCT Filed: Mar. 31, 2016

(86) PCT No.: PCT/US2016/025122
§ 371 (c)(1),
(2) Date: Sep. 26, 2018

(87) PCT Pub. No.: WO2017/171763
PCT Pub. Date: Oct. 5, 2017

(65) Prior Publication Data

US 2019/0093487 A1 Mar. 28, 2019

(51) Int. Cl.
*F01D 5/18* (2006.01)
*F01D 9/04* (2006.01)

(52) U.S. Cl.
CPC ..... *F01D 5/188* (2013.01); *F01D 5/186* (2013.01); *F01D 9/041* (2013.01);
(Continued)

(58) Field of Classification Search
CPC ..... F01D 5/188; F01D 5/186; F01D 9/041; F01D 5/187; F01D 5/189;
(Continued)

(56) References Cited

U.S. PATENT DOCUMENTS 5,538,394 A 7/1996 Inomata et al.
5,681,144 A * 10/1997 Spring ..... F01D 5/187 415/115
(Continued)

FOREIGN PATENT DOCUMENTS

DE 19526917 A1 1/1997
EP 0661414 A1 7/1995
(Continued)

OTHER PUBLICATIONS

PCT International Search Report and Written Opinion dated Dec. 22, 2016 corresponding to PCT Application No. PCT/US2016/025122 filed Mar. 31, 2016.

*Primary Examiner* — J. Todd Newton

(57) ABSTRACT

A turbine airfoil (10) includes a flow blocking body (26) positioned an internal cavity (40). A first near-wall cooling channel (72) is defined between the flow blocking body (26) and an airfoil pressure sidewall (16). A second near-wall cooling channel (74) is defined between the flow blocking body (26) and an airfoil suction sidewall (18). A connecting channel (76) is defined between the flow blocking body (26) an internal partition wall (24) that connects the airfoil pressure (16) and suction (18) sidewalls. The connecting channel (76) is connected to the first (72) and second (74) near-wall cooling channels along a radial extent. Turbulating features (90, 90*a-b*) are located in the connecting channel (76) and are formed on the flow blocking body (26) and/or on the partition wall (24). The turbulating features (90, 90*a-b*) are effective to produce a higher coolant flow rate through the first (72) and second (74) near-wall cooling channels in comparison to the connecting channel (76).

13 Claims, 5 Drawing Sheets

(52) U.S. Cl.
CPC .... *F05D 2220/32* (2013.01); *F05D 2240/127* (2013.01); *F05D 2250/183* (2013.01); *F05D 2250/185* (2013.01); *F05D 2260/202* (2013.01); *F05D 2260/2212* (2013.01)

(58) Field of Classification Search
CPC ..... F05D 2250/183; F05D 2260/202; F05D 2220/32; F05D 2240/127; F05D 2260/2212; F05D 2250/185
USPC ..... 416/97 R
See application file for complete search history.

(56) References Cited

U.S. PATENT DOCUMENTS 5,797,726 A * 8/1998 Lee ..... F01D 5/187 416/96 R
6,331,098 B1 * 12/2001 Lee ..... F01D 5/187 416/97 R
8,109,726 B2 * 2/2012 Liang ..... F01D 5/187 416/97 R
9,850,763 B2 * 12/2017 Itzel ..... F01D 5/188
2009/0068022 A1 * 3/2009 Liang ..... F01D 5/187 416/97 R
2016/0102563 A1 * 4/2016 Spangler ..... F01D 5/189 415/115
2017/0051612 A1 * 2/2017 Sezer ..... F01D 5/189
2017/0159456 A1 * 6/2017 Spangler ..... F23R 3/002

FOREIGN PATENT DOCUMENTS

EP 2149676 A1 2/2010
WO 2015171145 A1 11/2015
WO WO-2015171145 A1 * 11/2015 ..... F01D 5/18

* cited by examiner

VIEW II-II

VIEW IV-IV

VIEW V-V

VIEW VII-VII

TURBINE AIRFOIL WITH TURBULATING FEATURE ON A COLD WALL

BACKGROUND

1. Field

The present invention is directed generally to turbine airfoils, and more particularly to turbine airfoils having internal cooling channels for conducting a coolant through the airfoil.

2. Description of the Related Art

In a turbomachine, such as a gas turbine engme, air is pressurized in a compressor section and then mixed with fuel and burned in a combustor section to generate hot combustion gases. The hot combustion gases are expanded within a turbine section of the engine where energy is extracted to power the compressor section and to produce useful work, such as turning a generator to produce electricity. The hot combustion gases travel through a series of turbine stages within the turbine section. A turbine stage may include a row of stationary airfoils, i.e., vanes, followed by a row of rotating airfoils, i.e., turbine blades, where the turbine blades extract energy from the hot combustion gases for providing output power. Since the airfoils, i.e., vanes and turbine blades, are directly exposed to the hot combustion gases, they are typically provided with internal cooling channels that conduct a cooling fluid, such as compressor bleed air, through the airfoil.

One type of turbine airfoil includes a radially extending outer wall made up of opposite pressure and suction sidewalls extending from a leading edge to a trailing edge of the airfoil. The cooling channel extends inside the airfoil between the pressure and suction sidewalls and conducts the cooling fluid in alternating radial directions through the airfoil. The cooling channels remove heat from the pressure sidewall and the suction sidewall and thereby avoid overheating of these parts.

In a turbine airfoil, achieving a high cooling efficiency based on the rate of heat transfer is a significant design consideration in order to minimize the volume of coolant air diverted from the compressor for cooling.

SUMMARY

Briefly, aspects of the present invention provide a turbine airfoil with turbulating features on a cold wall.

According a first aspect, a turbine airfoil is provided. The turbine airfoil comprises an outer wall delimiting an airfoil interior. The outer wall extends span-wise along a radial direction of a turbine engine and is formed of a pressure sidewall and a suction sidewall joined at a leading edge and a trailing edge. At least one partition wall is positioned in the airfoil interior connecting the pressure and suction sidewalls along a radial extent so as define a plurality of radial cavities in the airfoil interior. An elongated flow blocking body is positioned in at least one of the radial cavities so as to occupy an inactive volume therein. The flow blocking body extends in the radial direction and is spaced from the pressure sidewall, the suction sidewall and the partition wall, whereby: a first near-wall cooling channel is defined between the flow blocking body and the pressure sidewall, a second near-wall cooling channel is defined between the flow blocking body and the suction sidewall, and a connecting channel is defined between the flow blocking body and the partition wall. The connecting channel is connected to the first and second near-wall cooling channels along a radial extent to define a flow cross-section for radial coolant flow. The turbine airfoil further comprises turbulating features located in the connecting channel and being formed on the flow blocking body and/or on the partition wall. The turbulating features are effective to produce a higher coolant flow rate through the first and second near-wall cooling channels in comparison to the connecting channel According a second aspect, a turbine airfoil is provided. The turbine airfoil comprises an outer wall delimiting an airfoil interior. The outer wall extends span-wise along a radial direction of a turbine engine and is formed of a pressure sidewall and a suction sidewall joined at a leading edge and a trailing edge. At least one partition wall is positioned in the airfoil interior connecting the pressure and suction sidewalls along a radial extent so as define a plurality of radial cavities in the airfoil interior. An elongated flow blocking body is positioned in at least one of the radial cavities so as to occupy an inactive volume therein. The flow blocking body extends in the radial direction and is spaced from the pressure sidewall, the suction sidewall and the partition wall, whereby: a first near-wall cooling channel is defined between the flow blocking body and the pressure sidewall, a second near-wall cooling channel is defined between the flow blocking body and the suction sidewall, and a connecting channel is defined between the flow blocking body and the partition wall. The connecting channel is connected to the first and second near-wall cooling channels along a radial extent. The turbine airfoil further comprises means for locally enhancing flow friction in the connecting channel, for effecting a higher coolant flow rate through the first and second near-wall cooling channels in comparison to the connecting channel

BRIEF DESCRIPTION OF THE DRAWINGS

The invention is shown in more detail by help of figures. The figures show preferred configurations and do not limit the scope of the invention.

DETAILED DESCRIPTION

Figure 1:
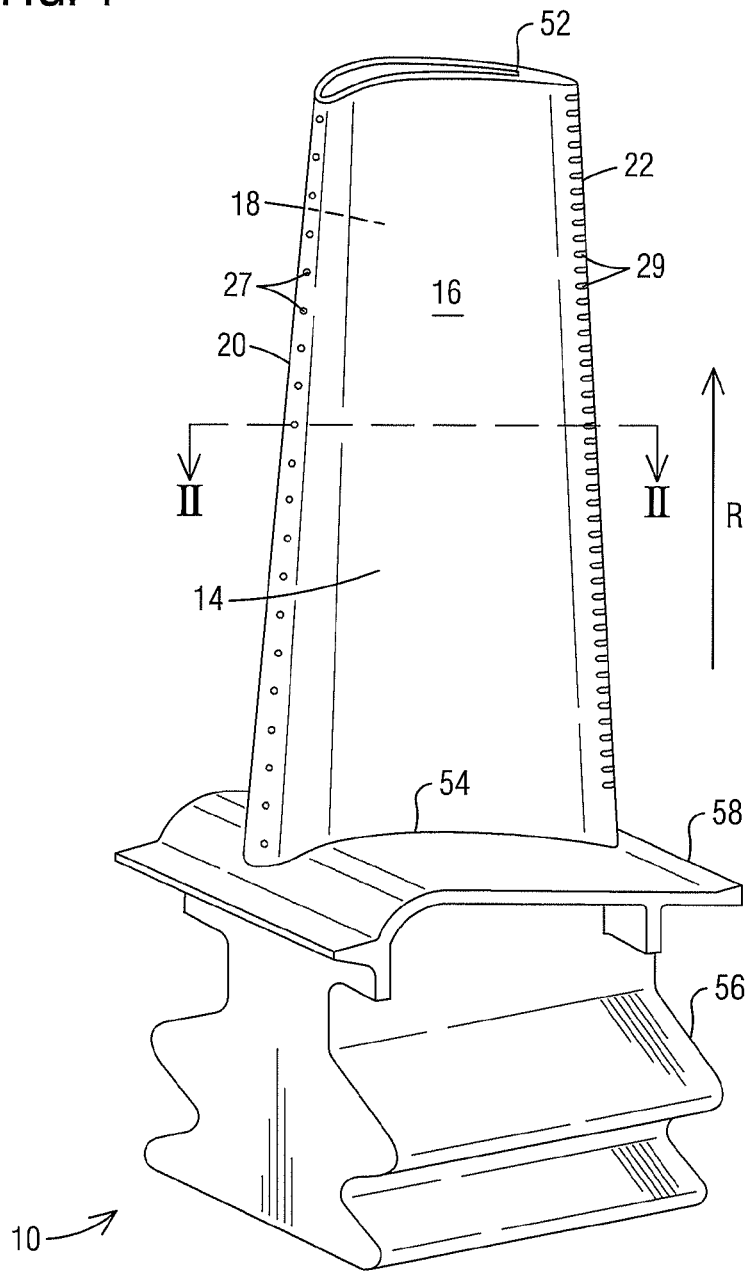
FIG. 1 is a perspective view of a turbine airfoil featuring embodiments of the present invention.

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Aspects of the present invention relate to an internally cooled turbine airfoil. In a gas turbine engine, coolant supplied to the internal cooling channels in a turbine airfoil often comprises air diverted from a compressor section. Achieving a high cooling efficiency based on the rate of heat transfer is a significant design consideration in order to minimize the volume of coolant air diverted from the compressor for cooling. Many turbine blades and vanes involve a two-wall structure including a pressure sidewall and a suction sidewall joined at a leading edge and at a trailing edge. Internal cooling channels are created by employing internal partition walls or ribs which connect the pressure and suction sidewalls in a direct linear fashion. It has been noted that while the above design provides low thermal stress levels, it may pose limitations on thermal efficiency resulting from increased coolant flow due to their simple forward or aft flowing serpentine-shaped cooling channels and relatively large flow cross-sectional areas. In a typical two-wall turbine airfoil as described above, a significant portion of the radial coolant flow remains toward the center of the flow cross-section between the pressure and suction sidewalls, and is hence underutilized for convective cooling.

Thermal efficiency of a gas turbine engine may be increased by lowering the coolant flow rate. However, as available coolant air is reduced, it may become significantly harder to cool the airfoil. For example, in addition to being able to carry less heat out of the airfoil, the lower coolant flows also make it much more difficult to generate high enough internal Mach numbers to meet cooling requirements. To address this issue, techniques have been developed to implement near-wall cooling, such as that disclosed in the International Application No. PCT/US2015/047332, filed by the present applicant, and herein incorporated by reference in its entirety. Briefly, such a near-wall cooling technique employs the use of a flow displacement element to reduce the flow cross-sectional area of the coolant, thereby increasing convective heat transfer, while also increasing the target wall velocities as a result of the narrowing of the flow cross-section. Furthermore, this leads to an efficient use of the coolant as the coolant flow is displaced from the center of the flow cross-section toward the hot walls that need the most cooling, namely, the pressure and suction sidewalls. Embodiments of the present invention provide a further improvement on the aforementioned near-wall cooling technique.

Referring now to FIG. 1, a turbine airfoil 10 is illustrated according to one embodiment. As illustrated, the airfoil 10 is a turbine blade for a gas turbine engine. It should however be noted that aspects of the invention could additionally be incorporated into stationary vanes in a gas turbine engine. The airfoil 10 may include an outer wall 14 adapted for use, for example, in a high pressure stage of an axial flow gas turbine engine. The outer wall 14 extends span-wise along a radial direction R of the turbine engine and includes a generally concave shaped pressure sidewall 16 and a generally convex shaped suction sidewall 18. The pressure sidewall 16 and the suction sidewall 18 are joined at a leading edge 20 and at a trailing edge 22. The outer wall 14 may be coupled to a root 56 at a platform 58. The root 56 may couple the turbine airfoil 10 to a disc (not shown) of the turbine engine. The outer wall 14 is delimited in the radial direction by a radially outer end face or airfoil tip 52 and a radially inner end face 54 coupled to the platform 58. In other embodiments, the airfoil 10 may be a stationary turbine vane with a radially inner end face coupled to the inner diameter of the turbine section of the turbine engine and a radially outer end face coupled to the outer diameter of the turbine section of the turbine engine.

Figure 2:
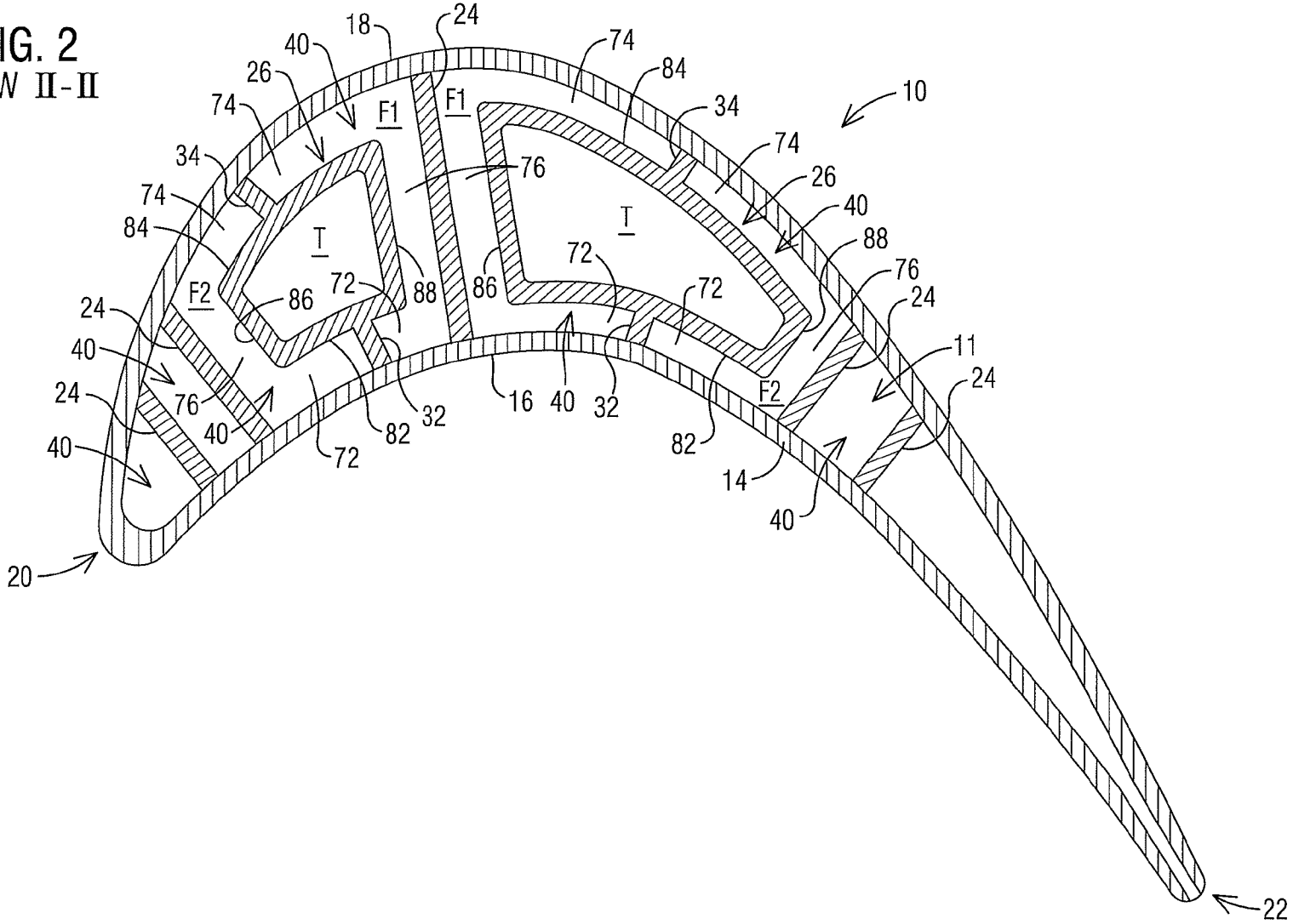
FIG. 2 is a cross-sectional view through the turbine airfoil along the section II-II of FIG. 1.

Referring to FIGS. 1 and 2, the outer wall 14 delimits an airfoil interior 11 comprising internal cooling channels, which may receive a coolant, such as air from a compressor section (not shown), via one or more cooling fluid supply passages (not shown) through the root 56. A plurality of partition walls 24 are positioned spaced apart in the interior portion 11. The partition walls 24 extend along a radial extent, connecting the pressure sidewall 16 and the suction sidewall 18 to define internal radial cavities 40. The coolant traverses through the radial cavities 40 and exits the airfoil 10 via exhaust orifices 27 and 29 positioned along the leading edge 20 and the trailing edge 22 respectively. The exhaust orifices 27 provide film cooling along the leading edge 20 (see FIG. 1). Although not shown in the drawings, film cooling orifices may be provided at multiple locations, including anywhere on the pressure sidewall 16, suction sidewall 18, leading edge 20 and the airfoil tip 52. However, embodiments of the present invention provide enhanced convective heat transfer using low coolant flow, which make it possible to limit film cooling only to the leading edge 20, as shown in FIG. 1.

Referring to FIG. 2, a flow displacement element in the form of a flow blocking body 26 is positioned in at least one of the radial cavities 40. In the present example, two such flow blocking bodies 26 are shown, each being elongated in the radial direction (perpendicular to the plane of FIG. 2). Each flow blocking body 26 occupies an inactive volume within the respective cavity 40. That is to say that there is no coolant flow through the volume occupied by the flow blocking body 26. Thereby a significant portion of the coolant flow in the cavity 40 is displaced toward the hot outer wall 14 for effecting near-wall cooling. In this case, each flow blocking body 26 has a hollow construction, having a cavity T therein through which no coolant flows. To this end, one or both radial ends of the cavity T may be capped or sealed off to prevent ingestion of coolant into the cavity T. In alternate embodiments, the flow blocking body 26 may have a solid construction. A hollow construction of the flow blocking bodies 26 may provide reduced thermal stresses as compared to a solid body construction, and furthermore may result in reduced centrifugal loads in case of rotating blades. As shown, a pair of connector ribs 32, 34 respectively connect the flow blocking body 26 to the pressure and suction sidewalls 16 and 18 along a radial extent. In a preferred embodiment, the flow blocking body 26 and the connector ribs 32, 34 may be manufactured integrally with the airfoil 10 using any manufacturing technique that does not require post manufacturing assembly as in the case of inserts. In one example, the flow blocking body 26 may be cast integrally with the airfoil 10, for example from a ceramic casting core. Other manufacturing techniques may include, for example, additive manufacturing processes such as 3-D printing. This allows the inventive aspects to be used for highly contoured airfoils, including 3-D contoured blades and vanes.

The illustrated cross-sectional shape of the flow blocking bodies 26 is exemplary. The precise shape of the flow blocking body 26 may depend, among other factors, on the shape of the radial cavity 40 in which it is positioned. In the illustrated embodiment, each flow blocking body 26 comprises first and second opposite side faces 82 and 84. The first side face 82 is spaced from the pressure sidewall 16 such that a first radially extending near-wall cooling channel 72 is defined between the first side face 82 and the pressure sidewall 16. The second side face 84 is spaced from the suction sidewall 18 such that a second radially extending near-wall cooling channel 74 is defined between the second side face 84 and the suction sidewall 18. Each flow blocking body 26 further comprises third and fourth opposite side faces 86 and 88 extending between the first and second side faces 82 and 84. The third and fourth side faces 86 and 88 are respectively spaced from the partition walls 24 on either side to define a respective connecting channel 76 between the respective side face 86, 88 and the respective partition wall 24. Each connecting channel 76 is connected to the first and second near-wall cooling channels 72 and 74 along a radial extent to define a flow cross-section for radial coolant flow. The provision of the connecting channel 76 results in reduced thermal stresses in the airfoil 10 and may be preferable over structurally sealing the gap between the flow blocking body 26 and the respective partition wall 24.

The resultant flow cross-section in each of the radial cavities 40 is generally C-shaped comprising of the first and second near-wall cooling channels 72, 74 and a respective connecting channel 76. A pair of adjacent radial flow passes F1, F2 of symmetrically opposed C-shaped flow cross-sections are formed on opposite sides of each flow blocking body 26. It should be noted that the term "symmetrically opposed" in this context is not meant to be limited to an exact dimensional symmetry of the flow cross-sections, which often cannot be achieved especially in highly contoured airfoils. Instead, the term "symmetrically opposed", as used herein, refers to symmetrically opposed relative geometries of the elements that form the flow cross-sections (i.e., the near-wall cooling channels 72, 74 and the connecting channel 76 in this example). Furthermore, the illustrated C-shaped flow cross-section is exemplary. Alternate embodiments may employ, for example, an H-shaped flow cross-section defined by the near-wall cooling channels and the connecting channel. The pair of adjacent radial flow passes F1 and F2 may conduct coolant in opposite radial directions, being fluidically connected in series to form a serpentine cooling path, as disclosed in the International Application No. PCT/US2015/047332 filed by the present applicant.

In order to enhance convective heat transfer between the coolant and the outer wall 14, it may be expedient to provide turbulator ribs on the inner face of the hot outer wall 14 at the pressure sidewall 16 and/or the suction sidewall 74. A technical effect arising from adding turbulator ribs to the hot outer wall 14 is that it may encourage more coolant to travel along the smooth walls adjoining the connecting channel 76 than along the turbulator ribbed outer wall 14 adjoining the near-wall cooling channels 72, 74. A higher coolant flow through the connecting channel 76 may actually enhance heat transfer at the relatively cold walls 24, 86 and 88, 24 forming the connecting channels 76, while debiting heat transfer at the relatively hot outer wall 14. The present inventors have devised a mechanism for enhancing heat transfer at the hot outer wall by modifying one or more of the cold walls so as to enhance a friction factor in the connecting channel 76 in relation to the near-wall cooling channels 72, 74. This would produce a higher coolant flow rate through the near-wall cooling channels 72, 74 in comparison to the connecting channel 76. The inventive mechanism thus goes against the conventional wisdom that a cold wall modification has little positive benefit on the internal hot wall heat transfer.

Figure 3:
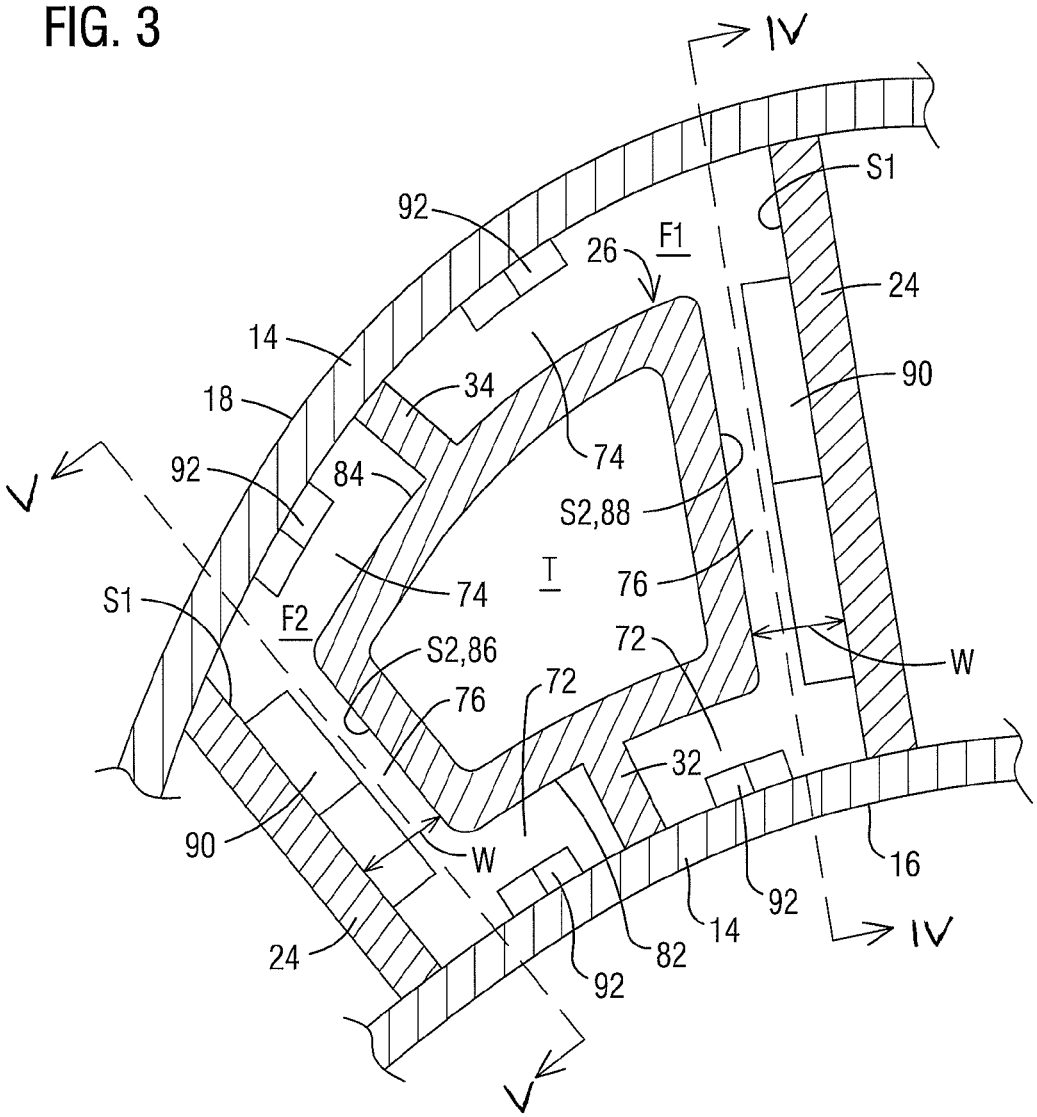
FIG. 3 is a highly schematic, enlarged, partial cross-sectional view depicting near-wall cooling channels connected by a connecting channel having turbulating features according to a first example embodiment of the present invention.
Figure 4:
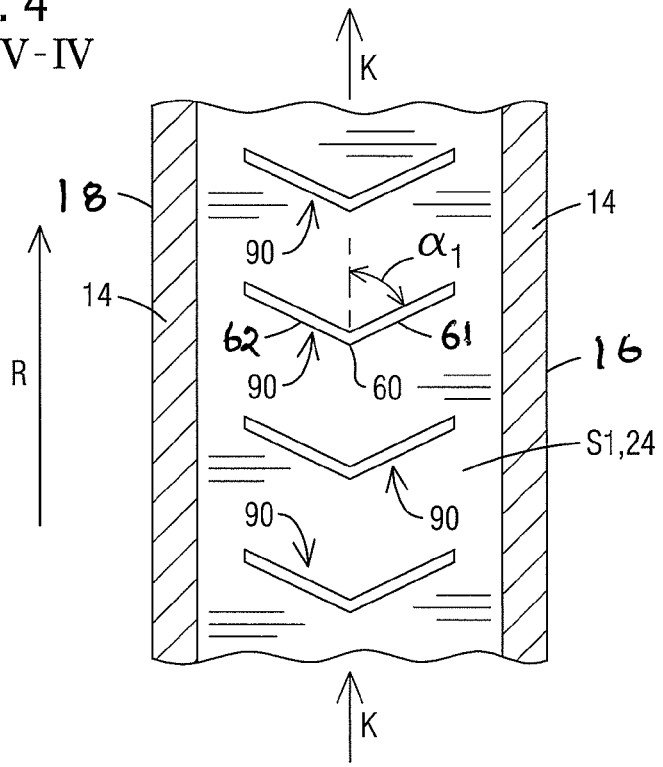
FIG. 4 is a partial cross-sectional view along the section IV-IV of FIG. 3 illustrating an exemplary configuration of turbulators in an "up" flowing radial flow pass.
Figure 5:
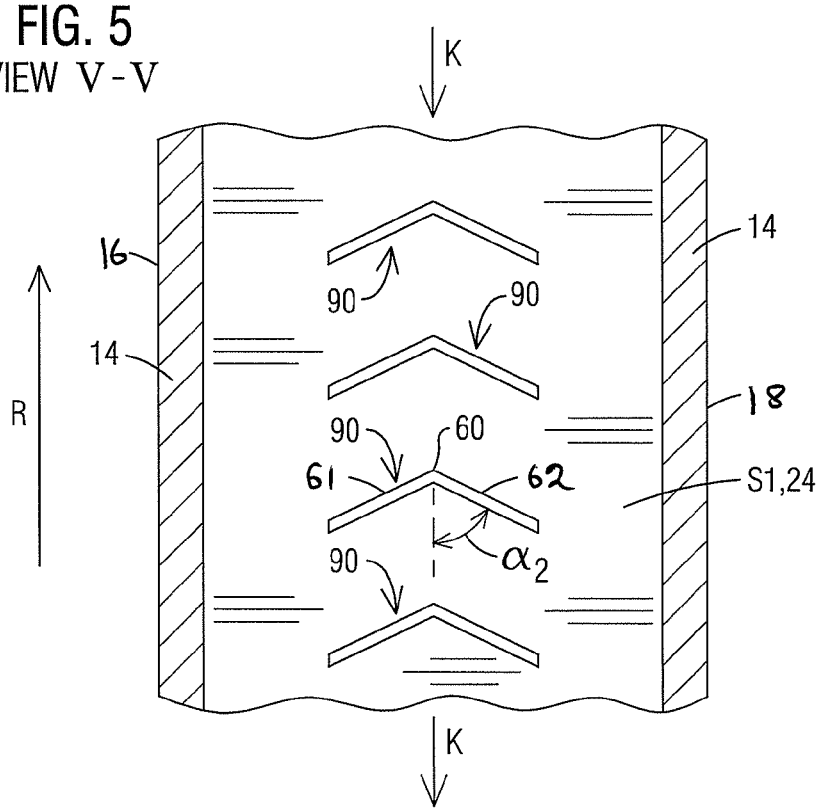
FIG. 5 is a partial cross-sectional view along the section V-V of FIG. 3 illustrating an exemplary configuration of turbulators in a "down" flowing radial flow pass.

FIGS. 3-5 illustrate a first example embodiment of the present invention. Referring to FIG. 3, each connecting channel 76 is defined between relatively cold walls including first and second opposing wall faces SI and S2. The first wall face SI is a side face of the partition wall 24 facing the respective connecting channel 76. The second wall face S2 is a side face (86 or 88) of the flow blocking body 26 facing the respective connecting channel 76. As per embodiments of the present invention, turbulating features in the form of turbulator ribs 90 may be located in one or more of the connecting channels 76. In this illustration, the turbulator ribs 90 are formed on the wall face SI of the partition walls 24. Alternately or additionally, the turbulator ribs 90 may be formed on one or both of the wall faces S2 of the flow blocking body 26. The turbulator ribs 90 may be formed on the wall faces SI and/or S2, for example, by way of any of the manufacturing techniques mentioned above. As shown in FIGS. 4 and 5, the turbulator ribs 90 may be arranged spaced apart in an array extending along a radial extent of the wall face S1. In one non-limiting example, the array may span the entire radial extent of the connecting channel 76. Furthermore, each turbulator rib 90 extends only partially across a width W of the connecting channel 76 defined between the opposing wall faces SI and S2. This ensures that there is no structural connection between the flow blocking body 26 and the partition wall 24 across the connecting channel 76, thereby minimizing thermal stresses in the airfoil.

The turbulator ribs 90 may be oriented in any direction transverse to the flow direction of the coolant K, i.e., transverse to the radial direction R. The arrangement of the turbulator ribs 90 enhances the friction factor for coolant flow through the connecting channel 76 in relation to the near-wall cooling channels 72, 74. As a result, the coolant flow tends to take the path of least resistance, leading to a local increase in coolant mass flow per unit area in the near-wall cooling channels 72, 74, at the cost of a local reduction in coolant mass flow per unit area in the connecting channel 76. Although the turbulator ribs 90 in the connecting channel 76 may increase the pressure drop of the channels somewhat, a net gain in hot wall heat transfer is achieved by effecting a higher coolant mass flow rate in the near-wall cooling channels 72, 74 than in the connecting channel 76. Since a large fraction of the coolant is now utilized for heat transfer with the hot outer wall 14, the coolant requirements may be reduced significantly, thereby increasing engine thermal efficiency. The geometry of the turbulator ribs 90, e.g. width of the turbulator ribs 90 across the connecting channel 76, radial height of the turbulator ribs 90, spacing between the turbulator ribs 90 etc., may be suitably designed to achieve a desired friction factor in each of the connecting channels 76.

In addition to increasing the friction factor of the connecting channel 76, the turbulator ribs 90 may be further configured to deflect flow in the connecting channel 76 toward the near-wall cooling channels 72, 74. One non-limiting example to achieve the above result is to provide turbulator ribs 90 with a V-shaped profile as shown in FIGS. 4 and 5. The V-shaped turbulator ribs 90 each comprises arms 61 and 62 extending away from an apex 60 toward the first and second near-wall cooling channels 72, 74 respectively. In one embodiment, as shown, the arms 61 and 62 may be connected at the apex 60. In alternate embodiments, the arms 61 and 62 may be spaced apart, i.e., not connected at the apex 60, in which case the apex 60 may be defined by an intersection of the longitudinal axes of the arms 61 and 62. Furthermore, the arms 61, 62 may be linear or curved. The apex 60 may be located, for example, at the center of the connecting channel 76. Each of the arms 61 and 62 makes an acute angle $a_1$, $a_2$ with respect to the flow direction of the coolant K such that the radially flowing coolant K is deflected from the apex 60 toward the near-wall cooling channels 72 and 74 by the arms 61 and 62. Deflecting the coolant K from the connecting channel 76 to the near-wall cooling channels 72, 74 leads to a further local reduction in coolant mass flow per unit area in the connecting channel 76 and a corresponding local increase in coolant flow per unit area in the near-wall cooling channels 72, 74. In this example, the adjacent radial flow passes F1 and F2 conduct coolant in opposite radial directions. In particular, the flow pass F1 is configured as an "up" pass (flowing from root to tip) and the flow pass F2 is configured as a "down" pass (flowing from tip to root). As depicted in FIGS. 4 and 5, the V-shaped turbulator ribs 90 in the flow passes F1 and F2 have radially inverted profiles with respect to each other, such that in each case, the arms 61 and 62 make an acute angle $a_1$, $a_2$ with respect to the positive flow direction of the coolant K in the respective flow pass F1, F2.

It should be emphasized that the above-described V-shaped turbulator geometry is exemplary and other geometrical configurations may be employed. For example, in alternate embodiments, the turbulating features 90 may have a curvilinear or arc-shaped profile. In yet other embodiments, each of the the turbulating features 90 may consist of a straight rib that may be arranged inclined with respect to the flow direction of the coolant K, or may be perpendicular thereto. The precise geometry of the turbulating features may be determined, in each case, to achieve a desired flow friction factor in the connecting channel 76, and as an optional benefit, to deflect coolant from the connecting channel 76 toward the near-wall cooling channels 72, 74.

In order to further enhance convective heat transfer at the outer wall 14, additional turbulating features 92 may be optionally provided on one or both of the near-wall cooling channels 72, 74. In this case, the turbulating features 92 may be formed on the inner surface of the outer wall 14 at the pressure sidewall 16 and/or the suction sidewall 18. The turbulating features 90 and 92 may be mutually configured so as to produce a higher friction factor in the connecting channel 76 than in the near-wall cooling channels 72, 74, such that the coolant flow rate through the near-wall cooling channels 72, 74 is still higher than the connecting channel 76. For example, the turbulating features 92 may be dimensioned smaller in terms of width, and/or height, and/or array size with respect to the turbulating features 90.

Figure 6:
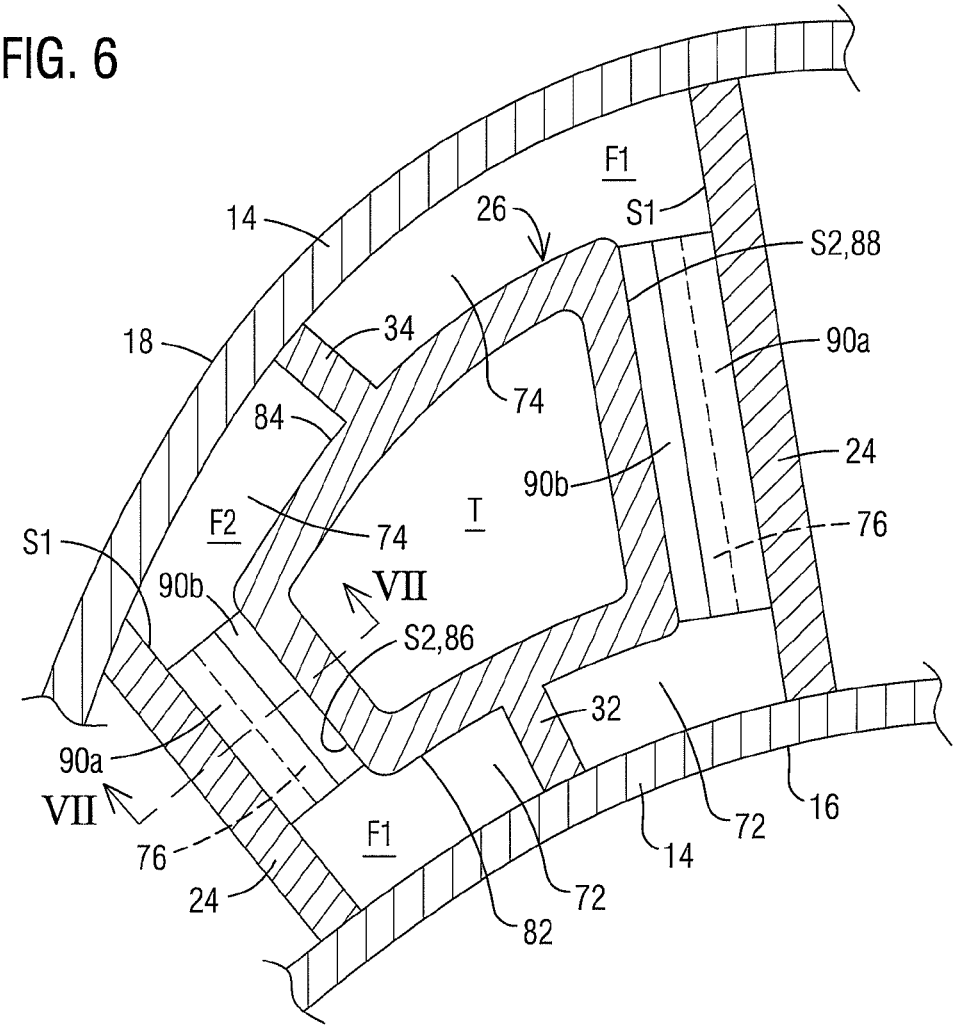
FIG. 6 is a highly schematic, enlarged, partial cross-sectional view depicting near-wall cooling channels connected by a connecting channel having turbulating features according to a second example embodiment of the present invention.
Figure 7:
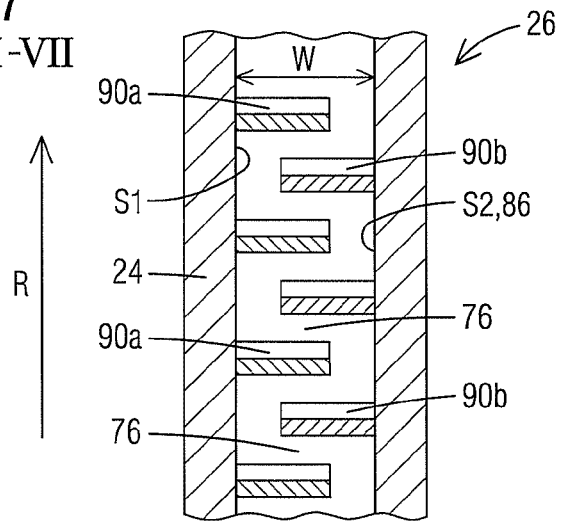
FIG. 7 is a partial cross-sectional view along the section VII-VII of FIG. 6.

FIGS. 6 and 7 illustrate a second example embodiment of the present invention. In this case turbulating features are formed on both the opposing wall faces S1 and S2 defining the connecting channel 76. In this example, a first array of turbulator ribs 90*a* is arranged along a radial extent of the wall face S1 of the partition wall 24 and a second array of turbulator ribs 90*b* is arranged along a radial extent of the wall face S2 of the flow blocking body 26. The turbulator ribs 90*a* and 90*b* may have any geometry, including, for example, that described in the previous embodiment. In the present embodiment, as shown in FIG. 7, the turbulator ribs 90*a* on the wall face SI are staggered in a radial direction in relation to the turbulator ribs 90*b* on the second wall face S2. This allows the turbulator ribs 90*a* and 90*b* to overlap partially along the width W of the connecting channel 76. As shown in FIG. 6, looking radially top-down, the arrangement of the turbulator ribs 90*a* and 90*b* covers the entire flow cross-section of the connecting channel, without any structural connection between the partition wall 24 and the flow blocking body 26 across the connecting channel 76. Such an arrangement effectively prevents any radial coolant flow in the connecting channel 76 while diverting virtually the entire coolant flow to the near-wall cooling channels 72, 74. Since nearly the entire coolant may now be used for heat transfer with the hot outer wall 14, the coolant requirements may be even further reduced, thereby having an even bigger positive effect on engine thermal efficiency.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A turbine airfoil comprising:

an outer wall delimiting an airfoil interior, the outer wall extending span-wise along a radial direction of a turbine engine and being formed of a pressure sidewall and a suction sidewall joined at a leading edge and a trailing edge, at least one partition wall positioned in the airfoil interior connecting the pressure and suction sidewalls along a radial extent so as define a plurality of radial cavities in the airfoil interior, an elongated flow blocking body positioned in at least one of the radial cavities so as to occupy an inactive volume therein, the flow blocking body extending in the radial direction and being spaced from the pressure sidewall, the suction sidewall and the partition wall, whereby a first near-wall cooling channel is defined between the flow blocking body and the pressure sidewall, a second near-wall cooling channel is defined between the flow blocking body and the suction sidewall, and a connecting channel is defined between the flow blocking body and the partition wall, the connecting channel being connected to the first and second near-wall cooling channels along a radial extent to define a flow cross-section for radial coolant flow, and turbulating features located in the connecting channel and being formed on the flow blocking body and/or on the partition wall, the turbulating features being effective to produce a higher coolant flow rate through the first and second near-wall cooling channels in comparison to the connecting channel, wherein the turbulating features are configured to deflect coolant flow in the connecting channel toward the first and second near-wall cooling channels.

2. The turbine airfoil according to claim 1, wherein the connecting channel is defined between first and second opposing wall faces of the partition wall and the flow blocking body respectively, wherein the turbulating features comprise a plurality of turbulator ribs formed on the first wall face and/or the second wall face.

3. The turbine airfoil according to claim 2, wherein the plurality of turbulator ribs are arranged in an array extending along a radial extent of the first wall face and/or the second wall face.

4. The turbine airfoil according to claim 3, wherein the plurality of turbulator ribs comprises a first array of turbulator ribs arranged along a radial extent of the first wall face and a second array of turbulator ribs arranged along a radial extent of the second wall face.

5. The turbine airfoil according to claim 4, wherein the turbulator ribs on the first wall face are staggered in a radial direction in relation to the turbulator ribs on the second wall face.

6. The turbine airfoil according to claim 5 wherein the turbulator ribs on the first wall face and the turbulator ribs on the second wall face partially overlap along a width of the connecting channel between the first and second wall faces.

7. The turbine airfoil according to claim 1, wherein the turbulating features are configured to locally increase a friction factor of the connecting channel.

8. The turbine airfoil according to claim 7, wherein the turbulating features are oriented transverse to a flow direction of coolant through the connecting channel.

9. The turbine airfoil according to claim 1, wherein the turbulating features comprise an array of turbulator ribs arranged along a flow direction of coolant, the turbulator ribs being inclined at an angle with respect to the flow direction of the coolant, to deflect the coolant from the connecting channel toward the first and/or second near-wall cooling channels.

10. The turbine airfoil according to claim 9, wherein the turbulator ribs each comprise first and second arms that extend away from an apex respectively toward the first near-wall cooling channel and the second near-wall cooling channel.

11. The turbine airfoil according to claim 1, further comprising one or more additional turbulating features located on the first and/or second near-wall cooling channels, the turbulating features and the additional turbulating features being mutually configured so as to produce a higher friction factor in the connecting channel than in the first and/or second near-wall cooling channels.

12. The turbine airfoil according to claim 1, further comprising pair of connector ribs that respectively connect the flow blocking body to the pressure and suction sidewalls along a radial extent, whereby a pair of adjacent radial flow passes of symmetrically opposed flow cross-sections are defined on opposite sides of the flow blocking body.

13. The turbine airfoil according to claim 12, wherein the pair of adjacent radial flow passes conduct coolant in opposite radial directions and are fluidically connected in series to form a serpentine cooling path.

* * * * *